US007416023B2

(12) United States Patent
Krueger et al.

(10) Patent No.: US 7,416,023 B2
(45) Date of Patent: Aug. 26, 2008

(54) FORMATION PRESSURE TESTING APPARATUS WITH FLEXIBLE MEMBER AND METHOD OF FORMATION PRESSURE TESTING

(75) Inventors: Sven Krueger, Celle (DE); Volker Krueger, Celle (DE); Wolfgang Herberg, Bergen (DE); Gunnar Bothmann, Celle (DE); Matthias Meister, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 10/871,460

(22) Filed: Jun. 18, 2004

(65) Prior Publication Data

US 2005/0011644 A1 Jan. 20, 2005

Related U.S. Application Data

(63) Continuation-in-part of application No. 10/100,670, filed on Mar. 18, 2002, now Pat. No. 6,837,314.

(51) Int. Cl.
*E21B 49/10* (2006.01)
*E21B 49/08* (2006.01)

(52) U.S. Cl. ..... 166/250.01; 166/264; 166/100; 73/152.22; 73/152.24

(58) Field of Classification Search ..... 166/264, 166/250.01, 100; 175/50; 73/152.22, 152.24, 73/152.26
See application file for complete search history.

(56) References Cited

U.S. PATENT DOCUMENTS 2,037,425 A * 4/1936 Martin ..... 73/706
2,547,876 A * 4/1951 Krasnow ..... 374/136
2,607,222 A * 8/1952 Lane ..... 73/152.26
3,301,063 A * 1/1967 Kisling, III et al. ..... 73/706
4,416,152 A 11/1983 Wilson ..... 73/155
4,510,800 A * 4/1985 Prior ..... 73/152.22
4,747,304 A 5/1988 King ..... 73/155
4,860,580 A * 8/1989 DuRocher ..... 73/152.26
4,860,581 A 8/1989 Zimmerman et al. ..... 73/155
5,353,637 A 10/1994 Plumb et al. ..... 73/151
5,358,057 A 10/1994 Peters et al. ..... 175/20
6,088,294 A 7/2000 Leggett, III et al. ..... 367/25
6,155,608 A 12/2000 Skinner et al. ..... 285/125.1
6,157,893 A 12/2000 Berger et al. ..... 702/9
6,206,108 B1 3/2001 MacDonald et al. ..... 175/24
6,427,530 B1 8/2002 Krueger et al. ..... 73/152.46
6,439,046 B1 8/2002 Kruspe et al. ..... 73/152.01

(Continued)

FOREIGN PATENT DOCUMENTS

EP 0362010 A2 4/1990

(Continued)

*Primary Examiner*—Shane Bomar
(74) *Attorney, Agent, or Firm*—Madan, Mossman & Sriram, P.C.

(57) ABSTRACT

An apparatus and method for use in determining pressure at a formation of interest in-situ. A carrier carrying a tool is conveyed in a borehole. The tool includes a sealing member and a port exposable to the formation of interest. A formation fluid sampling chamber is separated from a hydraulic fluid chamber by a flexible member that allows pressure communication from the fluid sampling chamber to the hydraulic fluid chamber. A sensor senses pressure in the hydraulic fluid for determining pressure in the sampling chamber.

27 Claims, 8 Drawing Sheets

U.S. PATENT DOCUMENTS

| | | | | |
|---|---|---|---|---|
| 6,675,914 | B2 * | 1/2004 | Masak | 175/48 |
| 2004/0083805 | A1 * | 5/2004 | Ramakrishnan et al. | 73/152.51 |

FOREIGN PATENT DOCUMENTS

| | | | |
|---|---|---|---|
| EP | 0978630 | A2 | 2/2000 |
| GB | 2334981 | | 8/1998 |
| GB | 2377952 | A | 1/2003 |

* cited by examiner

FORMATION PRESSURE TESTING APPARATUS WITH FLEXIBLE MEMBER AND METHOD OF FORMATION PRESSURE TESTING

CROSS REFERENCE TO RELATED APPLICATIONS

This application is a continuation-in-part of U.S. patent application Ser. No. 10/100,670 for "Sub Apparatus with Exchangeable Modules and Associated Method" filed on Mar. 18, 2002 now U.S. Pat. No. 6,837,314, the entire contents of which are hereby incorporated herein by reference.

BACKGROUND OF THE INVENTION

1. Field of the Invention

This invention relates generally to apparatus and methods for evaluating formations traversed by a well borehole, and more particularly to a testing apparatus and method for determining formation characteristics and preventing contamination of tool inner mechanisms and sensors.

2. Description of the Related Art

In the oil and gas industry, formation testing tools have been used for monitoring formation pressures along a well borehole, obtaining formation fluid samples from the borehole and predicting performance of reservoirs around the borehole. Such formation testing tools typically contain an elongated body having an elastomeric packer that is sealingly urged against a zone of interest in the borehole to collect formation fluid samples in fluid receiving chambers placed in the tool.

Downhole multi-tester instruments have been developed with extensible sampling probes for engaging the borehole wall at the formation of interest for withdrawing fluid samples therefrom and measuring pressure. In downhole instruments of this nature it is typical to provide an internal piston, which is reciprocated hydraulically or electrically to increase the internal volume of a fluid receiving chamber within the instrument after engaging the borehole wall. This action reduces the pressure at the instrument formation interface causing fluid to flow from the formation into the fluid receiving chamber of the instrument.

During drilling of a borehole, a drilling fluid ("mud") is used to facilitate the drilling process and to maintain a pressure in the borehole greater than the fluid pressure in the formations surrounding the borehole. This is particularly important when drilling into formations where the pressure is abnormally high: if the fluid pressure in the borehole drops below the formation pressure, there is a risk of blowout of the well. As a result of this pressure difference, the drilling fluid penetrates into or invades the formations for varying radial depths (referred to generally as invaded zones) depending upon the types of formation and drilling fluid used. The formation testing tools retrieve formation fluids from the desired formations or zones of interest, test the retrieved fluids to ensure that the retrieved fluid is substantially free of mud filtrates, and collect such fluids in one or more chambers associated with the tool. The collected fluids are brought to the surface and analyzed to determine properties of such fluids and to determine the condition of the zones or formations from where such fluids have been collected.

One feature that all such testers have in common is a fluid sampling probe. This may consist of a durable rubber pad that is mechanically pressed against the formation adjacent the borehole, the pad being pressed hard enough to form a hydraulic seal. Through the pad is extended one end of a metal tube that also makes contact with the formation. This tube ("probe") is connected to a sample chamber that, in turn, is connected to a pump that operates to lower the pressure at the attached probe. When the pressure in the probe is lowered below the pressure of the formation fluids, the formation fluids are drawn through the probe into the well bore to flush the invaded fluids prior to sampling. In some prior art devices, a fluid identification sensor determines when the fluid from the probe consists substantially of formation fluids; then a system of valves, tubes, sample chambers, and pumps makes it possible to recover one or more fluid samples that can be retrieved and analyzed when the sampling device is recovered from the borehole.

A problem associated with typical formation test tools is contamination within the tool inner mechanisms and sensors and consequent failures associated with such contamination. Another problem is increased time required even when only formation pressure testing is desired. There is a need for a quick formation pressure test that does not require large formation fluid volume and that does not allow contaminants into the tool inner mechanisms and sensors.

SUMMARY OF THE INVENTION

The present invention provides a formation evaluation tool and method to address some of the drawbacks existing in conventional tools used in drilling and other downhole well operations.

One aspect of the present invention is an apparatus for in-situ formation pressure testing. The apparatus includes a sealing member sealing a portion of a borehole wall adjacent a formation and a port exposable to the sealed portion to allow fluid communication between the formation and the port. A first chamber accepts a first fluid communicated from the formation. A second chamber contains a second fluid, which is a hydraulic fluid. A flexible member is between the first chamber and the second chamber, the flexible member providing pressure communication between the first chamber and the second chamber, the flexible member also preventing fluid communication between the first chamber and the second chamber. A sensor is in communication with the second chamber, the sensor sensing a characteristic of the second fluid, the characteristic being representative of pressure in the first chamber.

In one embodiment, the flexible member is made using an elastomeric sheet comprising a polymer. The polymer may be selected from a synthetic polymer or from a natural polymer ore a combination.

Another embodiment includes a pump acting on the second fluid in the second chamber, the pump pumping to reduce pressure in the second chamber below formation pressure, the reduced pressure communicated to the first chamber to draw formation fluid into the first chamber.

In another embodiment, the flexible member flexes from a first position to a second position and back to the first position, the first position resulting in a portion of the flexible member being substantially juxtaposed to the port providing a substantially zero volume in the first chamber. The flexible member flexes from the second position to the first position expelling through the port fluid in the first chamber. A reversible pump may be used to operate on the second fluid.

In yet another embodiment, the sealing member and the port are on an extendable probe having a probe body and an inner bore for accepting fluid from the formation through the port.

In another embodiment, a pump operates on the second fluid and a controller is coupled to the pump and to the sensor, the controller controlling the pump in a closed-loop manner based in part on an output signal received from the sensor. The controller may be used to control the pump to reduce pressurization effects at the port as the seal is pressed against the borehole wall.

A method according to the present invention includes conveying a tool to a borehole location adjacent a formation of interest, sealing a portion of the borehole wall at the location, communicating a first fluid from the formation into a first chamber in the tool through a port exposed to the sealed portion of the borehole wall, using a flexible member to separate the first chamber from a second chamber containing a second fluid, communicating pressure from the first chamber to the second chamber using the flexible member, and sensing a characteristic of the second fluid using a sensor in communication with the second chamber, the sensed characteristic being representative of pressure in the first chamber.

A system according to the present invention includes a carrier carrying a tool into a well borehole. The tool includes a sealing member sealing a portion of a borehole wall adjacent a formation, a port exposable to the sealed portion to allow fluid communication between the formation and the port, a first chamber accepting a first fluid communicated from the formation, a second chamber containing a second fluid, a flexible member between the first chamber and the second chamber. The flexible member provides pressure communication between the first chamber and the second chamber and prevents fluid communication between the first chamber and the second chamber. A sensor is in communication with the second chamber for sensing a characteristic of the second fluid. A pump within the carrier operates on the fluid in the second chamber, and a controller including a processor processes an output of the sensor. The processed sensor output being representative of pressure in the first chamber.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE INVENTION

Figure 1:
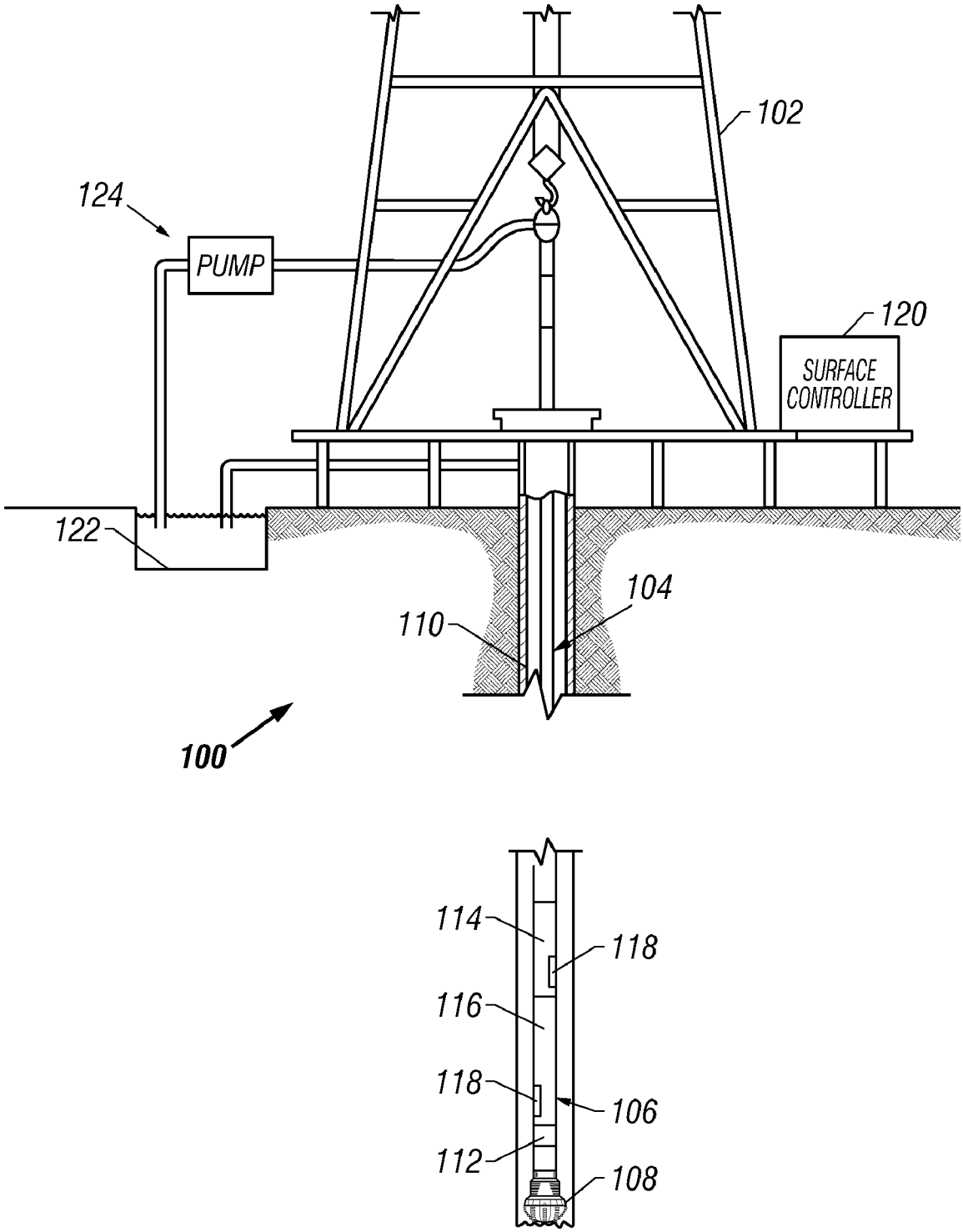
FIG. 1 is an elevation view of a drilling system including a modular sub according to one embodiment of the present invention.

FIG. 1 is an elevation view of a drilling system 100 in a measurement while drilling (MWD) arrangement according to the present invention. A conventional derrick 102 supports a drill string 104, which can be a coiled tube or drill pipe. The drill string 104 carries a bottom hole assembly (BHA) 106 and a drill bit 108 at its distal end for drilling a borehole 110 through earth formations.

Drilling operations include pumping drilling fluid or "mud" from a mud pit 122, and using a circulation system 124, circulating the mud through an inner bore of the drill string 104. The mud exits the drill string 104 at the drill bit 108 and returns to the surface through the annular space between the drill string 104 and inner wall of the borehole 110. The drilling fluid is designed to provide the hydrostatic pressure that is greater than the formation pressure to avoid blowouts. The pressurized drilling fluid also drives a drilling motor and provides lubrication to various elements of the drill string.

Modular subs 114 and 116 according to the present invention are positioned as desired along the drill string 104. As shown, the modular sub 116 may be included as part of the BHA 106. Each modular sub includes one or more modular components 118. The modular components 118 are preferably adapted to provide formation tests while drilling ("FTWD") and/or functions relating to drilling parameters. It is desirable for drilling operations to include modular components 118 adapted to obtain parameters of interest relating to the formation, the formation fluid, the drilling fluid, the drilling operations or any desired combination. Characteristics measured to obtain to desired parameter of interest may include pressure, flow rate, resistivity, dielectric, temperature, optical properties tool azimuth, tool inclination, drill bit rotation, weight on bit, etc. These characteristics are processed by a processor (not shown) downhole to determine the desired parameter. Signals indicative of the parameter are then telemetered uphole to the surface via a modular transmitter 112 located in the BHA 106 or other preferred location on the drill string 104.

Figure 2:
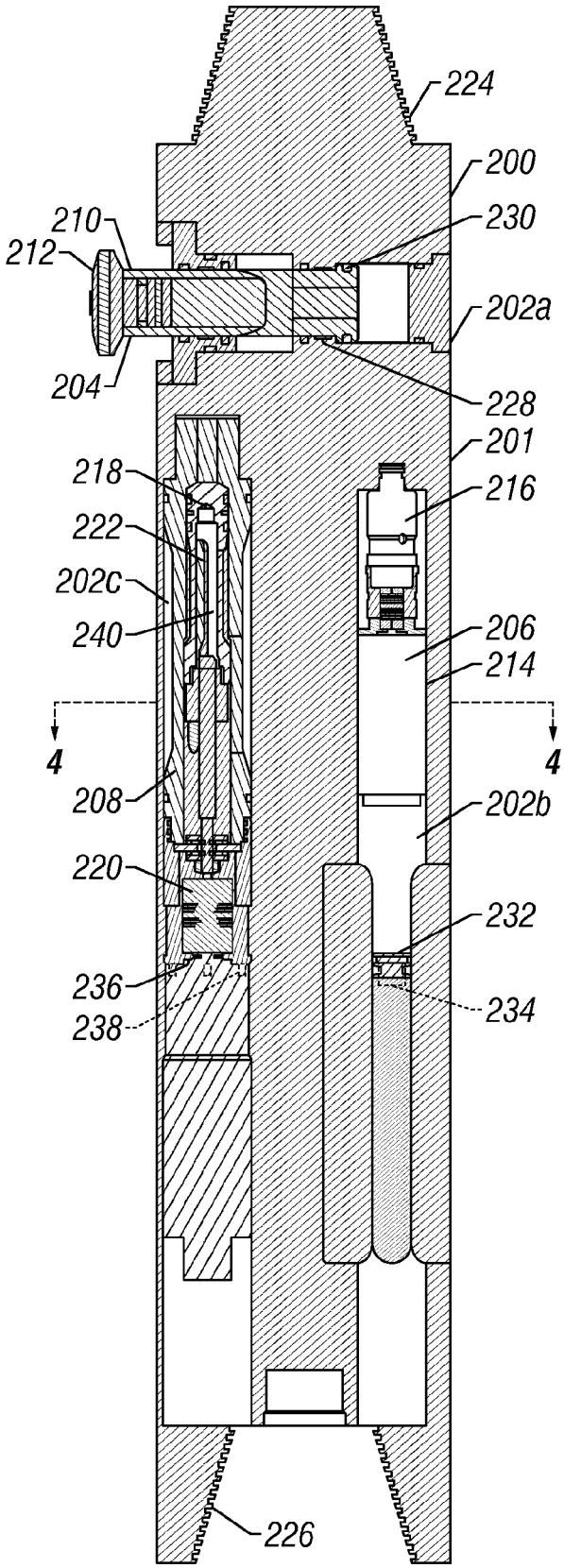
FIG. 2 shows a modular MWD sub according to the present invention adapted for use in the drilling system of FIG. 1.

FIG. 2 shows a modular MWD sub according to the present invention adapted for use in the drilling system of FIG. 1. The modular MWD sub, or simply sub 200 includes a sub body 201 and one or more receptacles 202*a-c* formed in the sub body 201. The term "receptacle" as used herein is defined as any recess, opening or groove formed in a structure for receiving a device. Each receptacle 202*a-c* is adapted to receive a modular tool component. The term modular tool component as used herein is defined as a device adapted for connection and disconnection with respect to a receptacle. FIG. 2 shows a probe module 204 coupled to the sub 200 in a probe receptacle 202*a*. A pump module 206 is coupled to the sub 200 in a pump receptacle 202*b*, and a test module 208 is shown coupled to the sub 200 in a test module receptacle 202*c*. Each module shown performs a desired function for MWD testing and/or drilling control.

The sub 200 is constructed using known materials and techniques for adapting the sub 200 to a drill string such as the drill string 104 shown in FIG. 1 and describes above. The sub 200 shown includes threaded couplings 224 and 226 for coupling the sub 200 to the drill string 104. The sub body 201 is preferably steel or other suitable metal for use in a downhole environment.

The probe module 204 includes an extendable probe 210 and a sealing pad 212 coupled to one end of the extendable probe 210. The probe module has a connector 228 that enables quick connection and detachment of the probe module 204 into the corresponding probe module receptacle 202*a*. The sub body 201 includes a connector 230 compatible with the probe connector 228. The connectors 228 and 230 may be any suitable connectors that allow quick insertion and detachment of the probe module 201. The connectors may be threaded connectors, plug-type connectors, or other suitable connector.

The probe module is operationally coupled to the pump module 206. Coupling the probe module 206 to the pump module 206 is accomplished when the modules 204 and 206 are installed in their respective receptacles 202*a* and 202*b*. The coupling mechanism depends upon the operating principles of the components. In one embodiment, the extendable probe module 204 is hydraulically operated and is coupled to the pump module 206 by fluid lines (not shown) pre-routed through the sub body 201. In another embodiment, the extendable probe module 204 is electrically operated and is coupled to the pump module 206 by electrical conductors (not shown) pre-routed through the sub body 201.

The sealing pad 212 is attached to a distal end of the extendable probe 210 using any suitable attaching device or adhesive. The sealing pad 212 is preferably a strong polymer material to provide for sealing a portion of the borehole wall when the when the extendable probe 210 is extended, while resisting wear-out caused by down-hole abrasive conditions. Any well-known sealing pad material may be used for constructing the sealing pad 212.

In the embodiment shown in FIG. 2, the pump module 206 is coupled to the probe module 204 as described above. The pump module 206 operates to extend and retract the extendable probe 210 and to extract or draw formation fluid from an adjacent formation (not shown). The pump module shown includes a motor 214 coupled to a pump 216. The motor 214 and pump 216 may be any suitable known motor and pump adapted according to the present invention for modular interface with the sub 200. Connectors 232 and 234 are used to detachably mount the pump module 206 into the pump module receptacle 202*b*. The connectors 232 and 234 are any suitable connectors that will provide mechanical and/or electrical detachable coupling for the pump module 206. The particular pump module selected will determine the connector required. For example, the pump module may comprise a ball-screw pump 216 driven by an electrical motor 214. The connectors 232 and 234 need not be functionally or mechanically identical to one another. For example, one connector 232 may be an electrical plug-type connector (as shown) for connecting power to the pump module, while the other connector 234 (as shown) may be a fluid quick-disconnect connector for coupling the pump 216 to fluid lines (not shown) leading to the probe module 204.

Continuing with the embodiment of FIG. 2, the test module 208 is detachably coupled to the sub body 201 in the test module receptacle 202*c* using suitable connectors 236 and 238. The connectors 236 and 238 are any suitable connectors that will provide mechanical and/or electrical detachable coupling for the test module 206. The particular test module selected will determine the connector required as described above with respect to the pump module and associated connectors. Likewise, the connectors 236 and 238 need not be functionally or mechanically identical to one another. For example, one connector 236 may be an electrical plug-type connector (as shown) for connecting power to the test module 208, while the other connector 238 (as shown) may be a fluid quick-disconnect connector for coupling the test module 208 to fluid lines (not shown) leading to the probe module 204.

The test module 208 shown includes a motor 220 and a fluid sampling device 222. The sampling device 222 is preferably a reciprocating piston operated by the motor 220. Alternatively, the fluid sampling device 222 may be a motor driven pump, wherein the motor may be an electric or a mud-driven motor. Alternatively, the sampling device may be a selectable valve that opens upon command, and formation pressure is used to urge fluid into the device. The test module 208 is operatively associated with the probe module 204 for determining one or more parameters of interest of the formation fluid received through the probe. These parameters of interest may be any combination of fluid pressured, temperature, resistivity, and fluid composition. The test module includes an appropriate sensor or sensors 218 for measuring characteristics indicative of the parameters of interest. For example, the test module may include any number of known pressure sensors, resistivity sensors, thermal sensors, and/or nuclear magnetic resonance (NMR) sensors. Alternatively, the sensors may be disposed within the probe module with the sensor output being transferred to the test module via electrical conductors (not shown) pre-routed within the sub.

In operation, formation fluid entering the probe module 204 is independently drawn into a chamber 240 located in the test module using the fluid sampling device 222. A sensor 218 as described above is coupled to the chamber for sensing a characteristic of the formation fluid drawn into the chamber. A downhole processor (not shown) is adapted to accept an output of the sensor 218 and to determine the desired parameter of interest associated with the measured characteristic.

Figure 3:
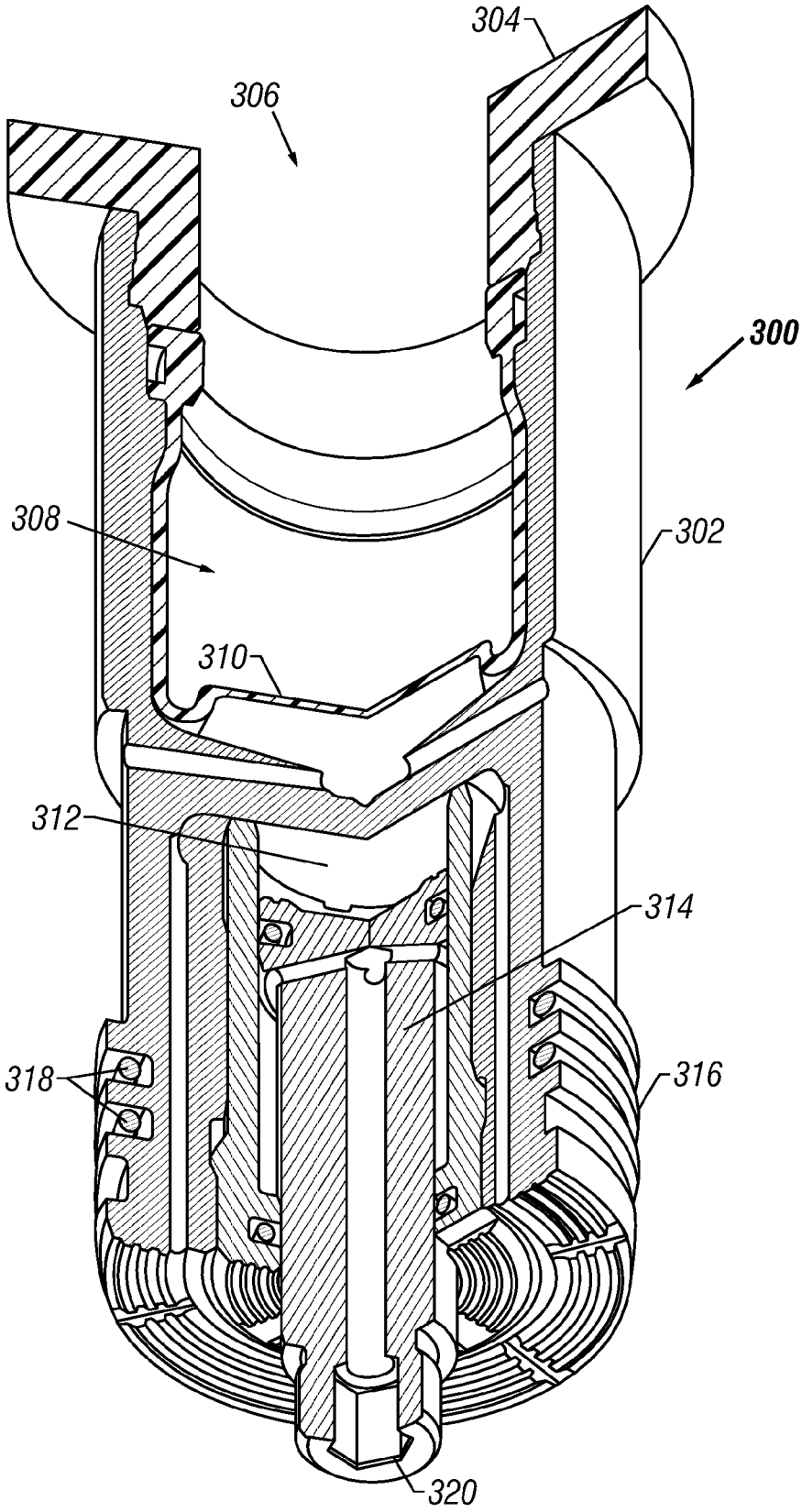
FIG. 3 is a cross sectional view of an extendable probe module according to the present invention.

A particularly useful modular probe for use in a probe module according to the present invention is shown in FIG. 3. FIG. 3 is a cross sectional view of an extendable probe module 300. The probe module 300 includes an extendable probe body 302 having a sealing pad member 304 disposed on an end thereof. The sealing pad member 304 is substantially identical to the sealing pad member 212 described above and shown in FIG. 2. The sealing pad member 304 is used to provide sealing engagement with a borehole wall when the probe body 302 is extended. A port 306 in the sealing pad member 306 allows formation fluid to enter a sample chamber 308 located in the probe body 302. The sample chamber 308 includes a flexible diaphragm or member 310 to separate the sample chamber 308 from a hydraulic oil chamber 312. The hydraulic oil chamber 312 and the sample chamber 308 remain in pressure communication via the flexible diaphragm 310.

The hydraulic oil chamber 312 is filled with a suitable oil or other hydraulic fluid. A piston 314 is operatively associated with the pump module 206 described above and shown in FIG. 2. Axial movement of the piston 314 changes the volume of the hydraulic oil chamber 312. Axial movement away from the flexible diaphragm 310 reduces pressure in the hydraulic oil chamber 312 and the diaphragm flexes to increase the volume of the sample chamber 308 thereby increasing the volume of the sample chamber 308. Increasing the volume of the sample chamber 308 urges formation fluid into the sample chamber 308 for testing.

When sampling and/or testing are complete, the piston 314 is operated in the opposing axial direction to purge the sample chamber 308 of formation fluid. This action also helps in retracting the probe 302 by increasing pressure in the sample chamber 308.

The modular probe 300 shown couples to the sub 200 in the probe receptacle 202*a*. A suitable probe coupling 316 is shown that allows detachable coupling to the sub 200 and provides a good seal. Standard O-ring seals 318 provide pressure sealing when the probe 300 is connected to the sub 200. An appropriate fitting 320 is integral to the piston 314 to allow automatic connection when the probe 300 is inserted into the probe receptacle 202*a*.

Figure 4:
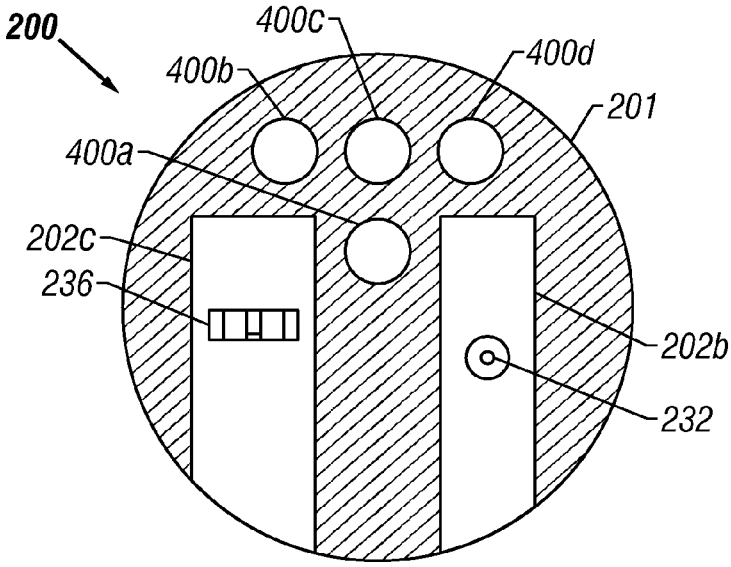
FIG. 4 is a cross sectional view of a drill pipe adapted to receive a fixed modular component.

FIG. 4 is a cross sectional view of the sub in FIG. 2 to show how drilling fluid is circulated through a modular sub 200 according to one embodiment of the present invention.

Shown in FIG. 4 is the sub body 201 including the pump module receptacle 202*b* and the test module receptacle 202*c*. The pump module 206 and the test module 208 described above and shown in FIG. 2 are removed for clarity. The pump module receptacle 202*b* is shown with the plug-type connector 232 as in FIG. 2 for coupling the pump module 206 to the sub body 201. The test module receptacle 202*c* is shown with the plug-type connector 236 of FIG. 2 for coupling the test module 208 to the sub body 201. Each module may be fitted with additional couplings such as fasteners as desired to ensure the associated modular component remains fixed within the sub body during operations.

During drilling, formation fluid must be circulated through the drilling system and thus must flow through the modular sub 200. To effect fluid flow through the sub 200, the sub body 201 has a plurality of fluid passageways 400*a-d* to allow drilling fluid to pass through the length of the sub 200 during drilling. The shape and number of individual passageways may be selected as desired to provide adequate flow through the sub 200. The shape and/or number of passageways may vary according to the number of component receptacles necessary for a particular modular sub.

Figure 5:
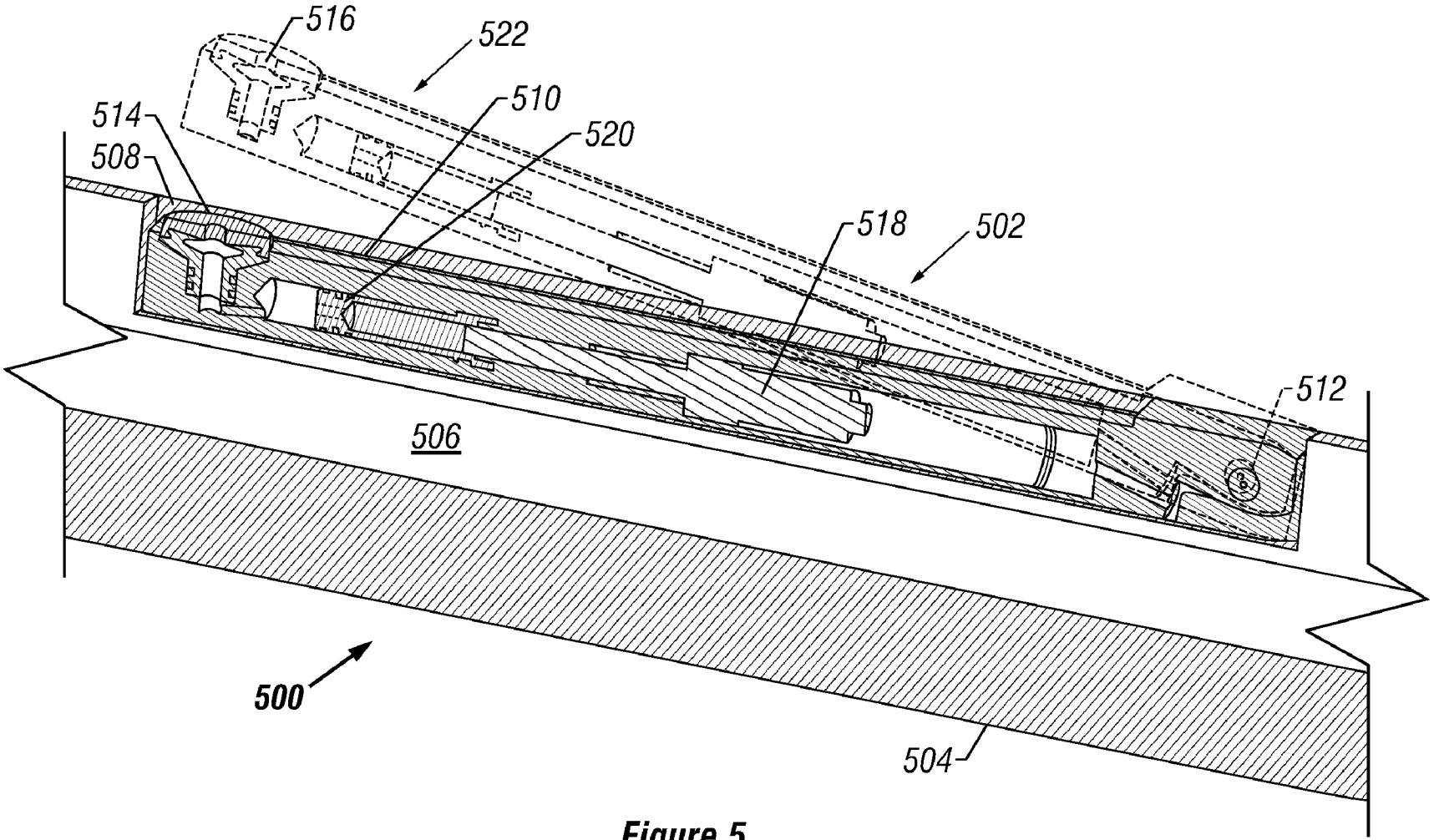
FIG. 5 shows an embodiment of the present invention wherein a modular sub includes a modular extendable rib assembly.

A modular rib capable of receiving formation fluid is provided in another embodiment of the present invention. FIG. 5 shows an embodiment of the present invention wherein a modular sub 500 includes an extendable rib module 502. The sub shown includes a sub body 504 having a central passageway 506 for allowing drilling fluid to flow through the sub body 504 during drilling operations. The sub body 504 has formed therein a recess 508 adapted for receiving the rib module 502.

The rib module 502 includes an elongated body 510 coupled to the sub body 504 at one end using a coupling 512 that preferably allows the rib module 502 to pivot at the coupling 512. The coupling 512 is preferably a pin-type coupling to allow release of the rib module when desired for repair or replacement. The rib module 502 is retractable into the recess 508 during drilling or otherwise when the sub 500 is moving within the borehole or is being transported.

The rib module 502 includes a pad member 514 disposed at a second end of the rib body 510. The pad 502 provides sealing engagement with the borehole wall when the rib is in an extended position as shown by dashed lines 522. The pad 514 includes a port 516 for receiving fluid. A pump 518 disposed in the rib module 502 is used to urge fluid into the port 516, and may also be used to expel fluid outwardly from the port 516. In a preferred embodiment the rib module 510 includes a power supply (not separately shown) such as a battery for operating the pump. In a preferred embodiment, the rib module 510 includes one or more sensors 520 and a processor (not separately shown) for testing the fluid entering the port. The processor is used to accept a sensor output and to process the output for determining a parameter of interest of the formation and/or the formation fluid. The sensed characteristic and parameter of interest are substantially identical to those described above with respect to the test module described above and shown in FIG. 2.

Figure 6:
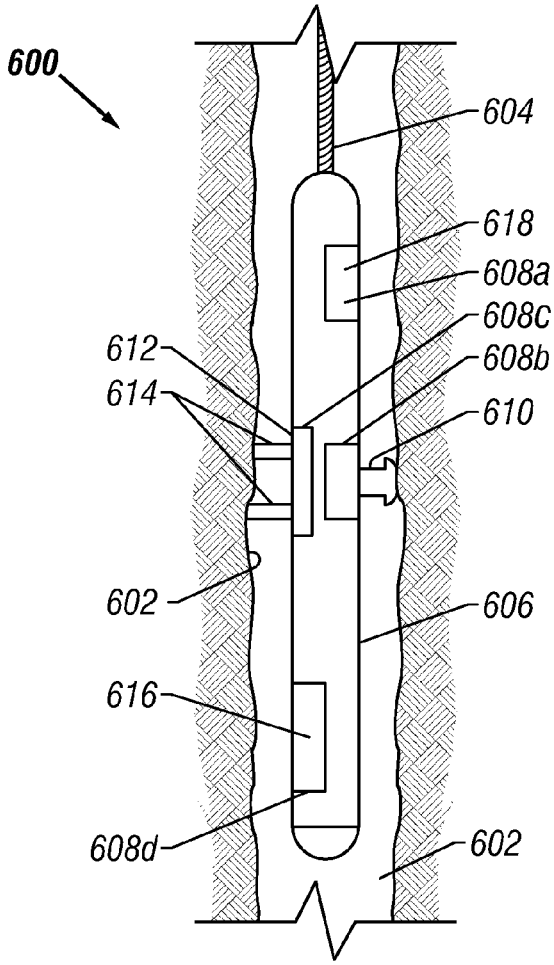
FIG. 6 is a modular wireline tool according to another embodiment of the present invention.

FIG. 6 is a modular wireline tool according to another embodiment of the present invention. The figure shows a wireline tool 600 suspended in a well borehole 602 by a cable 604 according to conventional practice. The tool includes a body 606 having a plurality of receptacles 608*a-d* for receiving modular testing components. In the embodiment shown an extendable probe module 610 is coupled to the body 606 in a corresponding receptacle 608*b*. The probe module 610 is substantially identical to the probe module 204 described above and shown in FIG. 2, the details of which do not require repeating here. A backup shoe module 612 is coupled to the body is a corresponding receptacle 608*c* positioned substantially diametrically opposed to the probe module 610. The backup shoe module 612 includes one or more extendable grippers 614 that engage the borehole wall for providing a counteracting force to keep the tool 600 centered in the borehole when the probe 610 is extended.

A controller module 618 is coupled to the body 606 in a corresponding controller module receptacle 608*a*. The controller module includes a processor (not separately shown) for controlling downhole components housed in the body 606. A sample/test module 616 is coupled to the in the body 606 in a corresponding sample/test module receptacle 608*d*. The sample test module 616 is operatively associated with the controller module 610 and the probe module 610 to perform wireline testing and sampling according to conventional practices. The sample test module 616 is fluidically coupled to the probe module 610 such that fluid received through the probe is conveyed to the sample test module for testing and/or storage. The sample/test module 616 is substantially identical to the sample/test module described above and shown in FIG. 2, thus is not described in detail here.

Once fluid is received at the probe module and conveyed to the sample/test module, sensors such as those described above and shown in FIG. 2 are used to sense a characteristic of the fluid. The sensor provides an output to the processor, and the processor processes the received output to determine one or more parameters of interest of the formation and/or the formation fluid. The parameter of interest may, of course, be any combination of parameters described above.

FIG. 7 Is a cross sectional view of another probe module 700 according to the invention. The probe 700 provides fast pressure tests and prevents contaminated fluid from entering the inner workings of the test apparatus carrying the probe. An advantage of the embodiment is that the apparatus is not prone to contamination-related failures as with other in-situ test devices that require pumping formation fluid and borehole fluid through the tool in order to obtain and test a sample. The probe module 700 includes a probe body 702 having a sealing pad member 704 disposed on an end thereof. The probe body may be extendable, but the embodiment will function just as well using packers or by moving the entire sub to one side of the borehole and pressing the a seal against the borehole wall. The sealing pad member 704 is substantially identical to the sealing pad member 212 described above and shown in FIG. 2. The sealing pad member 704 is used to provide sealing engagement with a borehole wall. A port 706 in the sealing pad member 704 allows formation fluid to enter a sample chamber 708 located in the probe body 702. The sample chamber 708 includes a flexible diaphragm or member 710 to separate the sample chamber 708 from a hydraulic oil chamber 712. The flexible member 710 may be coupled to the inner bore of the probe body using a clamp ring, by a bonding process or by a combination of the two. The hydraulic oil chamber 712 and the sample chamber 708 remain in pressure communication via the flexible member 710, but there is no fluid communication from the sample chamber 708 across the flexible member 710.

The hydraulic oil chamber 712 is filled with a suitable oil or other hydraulic fluid and is in fluid communication via conduit 714 with a pump module such as pump module 206 described above and shown in FIG. 2. Operating the pump module 206 increases or decreases the volume of the hydraulic oil chamber 712 to flex the flexible member 710. Flexing the flexible member will either draw fluid into the sample chamber 708 or expel fluid from the sample chamber 708 through the port 706.

Figure 7A:
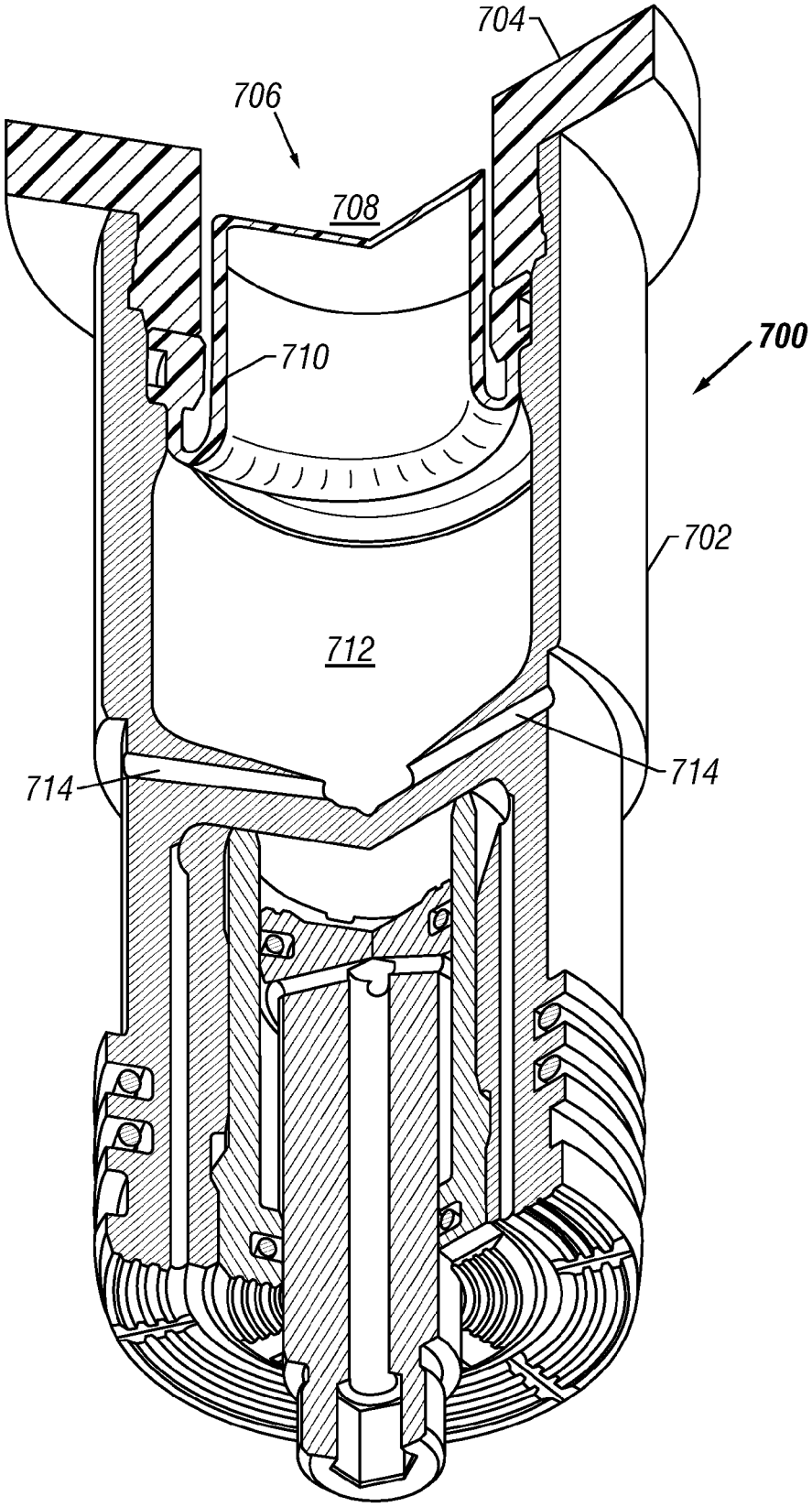
FIGS. 7A-B show another a probe module and flexible member according to another embodiment of the invention.

FIG. 7A shows the probe 700 with the flexible member 710 in its outermost flexed position making the volume of the sample chamber 708 substantially zero. This zero-volume position may occur prior to sealing against the borehole wall to allow more draw volume and to ensure borehole pressure does not affect pressure measurements. The low initial volume also helps prevent excessive pressure buildup at the probe port as the pad is pressed against the borehole wall. The zero-volume position of the flexible member 710 is also present after testing when the pump is used to flush formation fluid from the sample chamber back through the port 706.

Figure 7B:
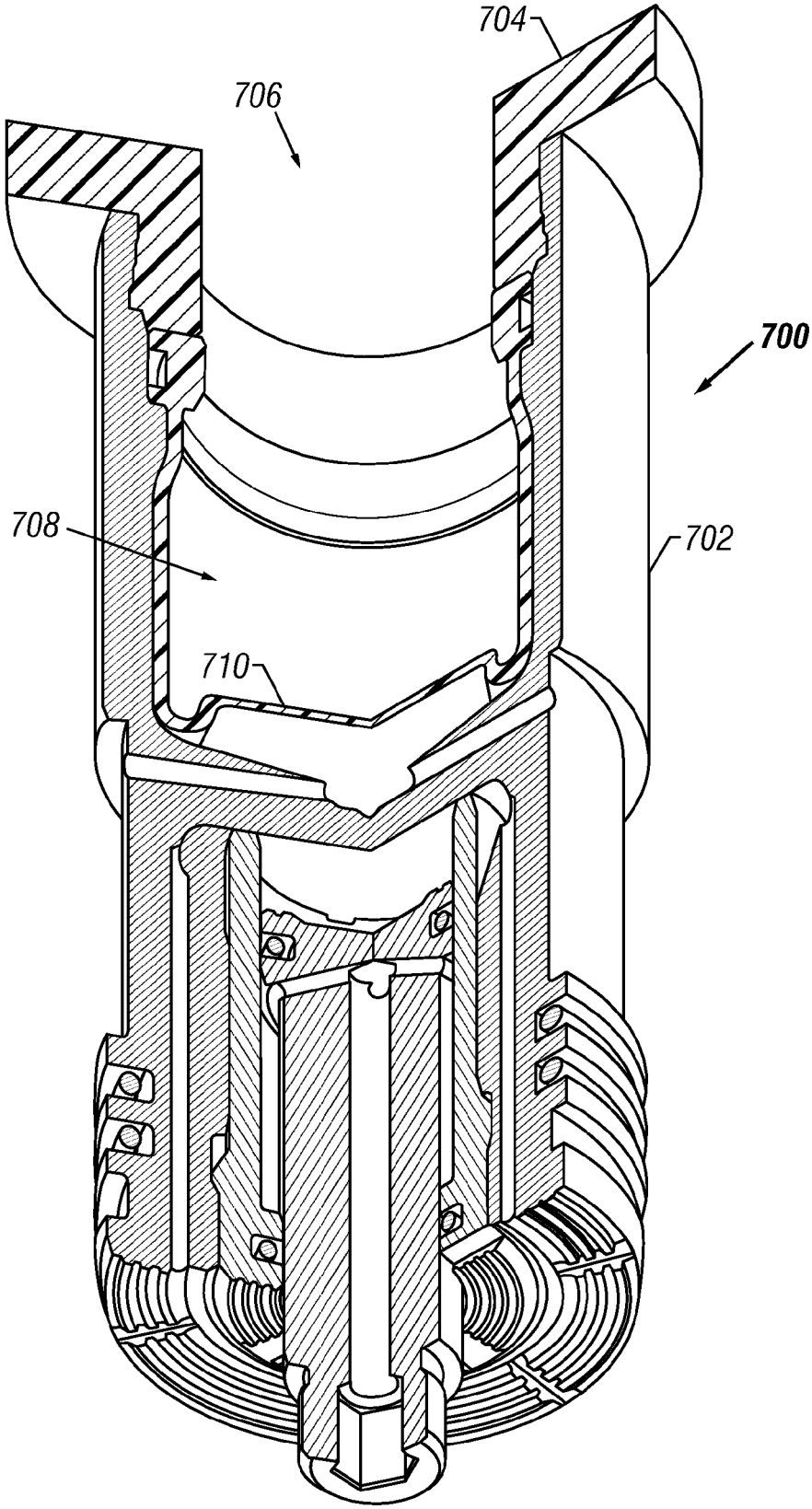

FIG. 7B shows the flexible member 710 at its inner flexed position that provides the volume in the sample chamber 706 for testing formation pressure. When the sample chamber fills with fluid, the pressure (Pf) in the chamber 706 will build and the pressure will communicate across the flexible member and affect the pressure (Ph) in the second chamber containing the hydraulic fluid. As will be discussed with reference to FIGS. 8A-8B, the second pressure Ph is measured to determine pressure Pf in the sample chamber 706 without the need for sample fluid to enter the tool inner mechanism. Therefore there can be no contamination of the test system.

The flexible member 710 may be any material suitable for repeated flexing and which withstand repeated trips into a well borehole. An example of such a material for manufacturing the flexible member is an elastomeric sheet comprising a polymer. The polymer may be a synthetic polymer, a natural polymer or a combination of the two. Any flexible material that will not allow fluid to pass from the sample chamber to the rest of the tool but will communicate pressure across the material will suffice for effective operation. Some pressure loss may be incurred across the flexible member making the sensed hydraulic fluid pressure Ph slightly different than the actual pressure Pf in the sample chamber. Such loss, however, is constant and can be determined and compensated for using a calibration process for the sensor and/or controller used to process the sensor output.

Figure 8A:
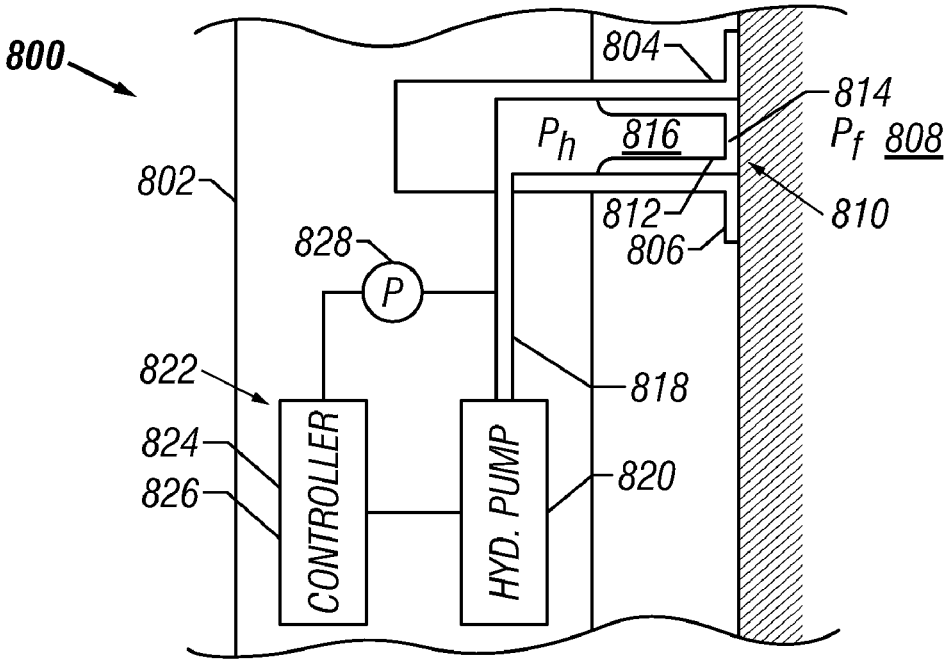
FIGS. 8A-B schematically illustrate operation of a probe according to FIGS. 7A-B.
Figure 8B:
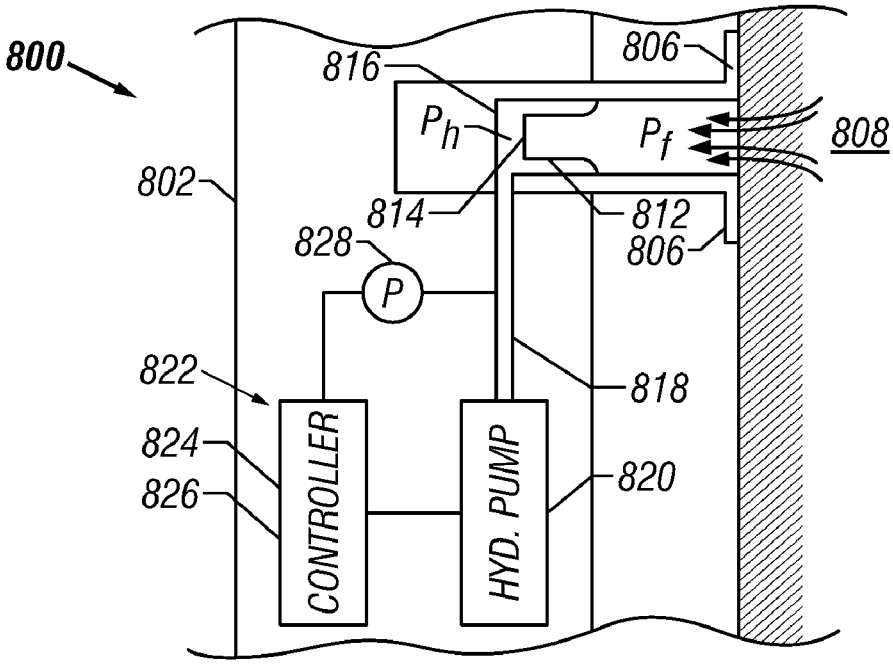

FIGS. 8A-B schematically illustrate operation of a probe according to FIG. 7. A tool 800 is conveyed into a well borehole on a carrier 802 such as a drill pipe, coiled tube or wireline. The tool 800 includes a probe 804 and a pad seal 806 shown here already pressed against the borehole wall to create a seal between the tool and an adjacent formation 808. Fluid communication from the formation to the tool is provided through a port 810 in the pad seal 806. As discussed above, the seal 806 may be a packer, and the probe is not necessary or does not need to be extended as shown if the seal can be pressed against the formation by moving the tool 800 to one side of the borehole wall.

As shown, the tool 800 includes a flexible member 812 that separates a sample chamber 814 from a hydraulic fluid chamber 816 and from the rest of the tool inner mechanisms and circuitry. A conduit 818 provides fluid communication from the hydraulic chamber 816 and a pump 820. A sensor (P) 828 is coupled to sense a characteristic of the hydraulic chamber 816. The sensor 828 can be any sensor useful in determining a desired characteristic of the hydraulic fluid chamber 816. In one embodiment the sensor includes a pressure sensor. The sensor might also include a temperature sensor or a displacement sensor. A controller 822 includes a processor 824 and a memory device 826 or simply memory 826. The controller is coupled to the sensor 828 and to the pump 820 to control the pump. Closed-loop control of the pump is accomplished using information derived down hole. Such information includes in part an output of the sensor 828 conveyed to and processed by the processor 824. The processed output can be stored in the memory 826. The processed output can be used in part by the controller to control the pump 820. For some embodiments, the pump may be a reversible pump so that the flexible member can be flexed in a bi-directional manner.

In one embodiment the pump 820 acts on the fluid in the hydraulic chamber 816 to reduce pressure in the hydraulic chamber. Pumping the hydraulic chamber to a pressure below formation pressure will provide a reduced pressure communicated to the sample chamber 814 to draw formation fluid into the sample chamber. It should be noted that the pump may not always be necessary.

In one embodiment the flexible member flexes from a first position to a second position and back to the first position. In the first position a portion of the flexible member is substantially juxtaposed to the port providing a substantially zero volume in the sample chamber. The second position providing a small volume for receiving fluid from the formation. The flexible member may be forcibly flexed from the second position (FIG. 8B) to the first position (FIG. 8A) to expel formation fluid through the port in preparation for another test or for moving the tool through the borehole. It should be noted that the pump 820 is not a necessity, because the flexible barrier will communicate pressure from the formation to the hydraulic fluid simply be pressing the seal and port against the borehole wall with the flexible member in the first (zero volume) position.

In one embodiment the pump is a reversible pump operating on the hydraulic fluid and the controller coupled to the pump and to the sensor controls the pump in a closed-loop manner based in part on an output signal received from the sensor to reduce pressurization effects at the port as the seal is pressed against the borehole wall.

The invention described above in various embodiments shown in FIGS. 1-8B is a modular sub configured for receiving a specified compliment of modular components. As such, the sub is fitted with connectors, wiring and tubing necessary for operation with the corresponding components. For example, a FTWD sub may include a probe module, a test/sampling module, and a controller module. The sub body includes pre-routed wiring and tubing that allows fluid communication between the probe module and the test/sampling module and data communication between the controller and the test/sampling module. The controller may be coupled to the probe module when using an extendable probe controlled by the controller.

Each component module and associated receptacle are preferably fitted with corresponding plug coupling devices to enable quick mating and demating of the component module to the sub. As used herein, the term plug coupling means a coupling that is adapted to mate fluid and/or electrical connections within the sub and component module without the use of tools. The term does not exclude, however, the possibility of using a fastener to mechanically secure the component module within the sub.

The foregoing description is directed to particular embodiments of the present invention for the purpose of illustration and explanation. It will be apparent, however, to one skilled in the art that many modifications and changes to the embodiments set forth above are possible without departing from the scope of the invention, which is defined by the claims appended hereto.

What is claimed is:

1. An apparatus for determining a pressure downhole comprising:

a first chamber having a flexible member for accepting a first fluid downhole;

a second chamber containing a second fluid; and the flexible member providing pressure communication between the first chamber and the second chamber, wherein the flexible member flexes from a first position to a second position to draw the first fluid into the first chamber and flexes from the second position to the first position to expel the fluid from the first chamber.

2. An apparatus according to claim 1, wherein the flexible member is an elastomeric member.

3. An apparatus according to claim 1 further comprising a sensor that senses a characteristic of the second fluid that is representative of a pressure of the first fluid.

4. An apparatus according to claim 1 further comprising a pump acting on the second fluid to reduce pressure in the second chamber to draw the first fluid into the first chamber.

5. An apparatus according to claim 1, wherein the flexible member flexes from the first position to the second position to provide a substantially zero volume in the first chamber.

6. An apparatus according to claim 1 further comprising a pump and a piston operating on the second fluid to change volume of the second fluid in the second chamber.

7. An apparatus according to claim 1 further comprising a sealing member and a port for accepting fluid from a formation into the first chamber.

8. An apparatus according to claim 7, wherein a controller controls a pump to reduce a pressurization effect at the port as the sealing member is pressed against the formation.

9. An apparatus according to claim 1 further comprising a pump operating on the second fluid and a controller to control the pump based in part on an output signal received from sensor.

10. An apparatus according to claim 1 further comprising one of: (i) a pump; and (ii) a piston to change a volume of the second fluid in the second chamber.

11. An apparatus of claim 1 further comprising a sealing member that seals a portion of a borehole wall and a port that allows entry of the first fluid into the first chamber.

12. A method of determining a pressure of a fluid downhole comprising:

conveying a tool into a borehole adjacent a formation;

placing a first chamber in the tool in fluid communication with a first fluid in the formation;

flexing a flexible member associated with the first chamber from a first position to a second position to draw the first fluid into the first chamber for determining the pressure of the fluid downhole and flexing the flexible member from the second position to the first position to expel the first fluid from the first chamber.

13. A method according to claim 12 further comprising: placing the first chamber in pressure communication with a second chamber having a second fluid; and sensing a characteristic of the second fluid that is representative of pressure of the first fluid to determine the pressure of the fluid downhole.

14. A method according to claim 13 further comprising controlling a volume of the second fluid in the second chamber in a closed-loop manner based in part on an output signal received from a sensor associate with the second fluid.

15. A method according to claim 13 further comprising controlling a pump with a controller to reduce a pressurization effect at a port associated with the first chamber for receiving the first fluid from the formation when the port is placed adjacent the formation.

16. A method according to claim 12 further comprising reducing pressure in the second chamber to draw the first fluid into the first chamber.

17. A method according to claim 12 further comprising flexing the flexible member from the first position to the second position to provide a substantially zero volume in the first chamber.

18. A system for use downhole comprising:

a tool including;

a sealing member and an associated port configured to obtain a first fluid from a formationl;

a first chamber having a flexible member for accepting the first fluid;

a second chamber containing a second fluid;

a flexible member providing pressure communication between the first chamber and the second chamber, wherein the flexible member is adapted to move from a first position to a second position to draw the first fluid into the first chamber and to move from the second position to the first position to expel the first fluid from the first chamber; and a sensor configured to sense a characteristic of the second fluid; and a processor processing an output of the sensor to estimate formation fluid pressure.

19. A system according to claim 18, wherein the flexible member comprises an elastomeric sheet comprising a polymer.

20. A system according to claim 19, wherein the polymer is selected from a synthetic polymer and a natural polymer.

21. A system according to claim 18 further comprising a pump that operates to reduce a pressure in the second chamber below the formation fluid pressure to draw the first fluid into the first chamber.

22. A system according to claim 21, wherein the pump is a reversible pump.

23. A system according to claim 21, wherein the processor controls the pump in a closed-loop manner based in part on the processed output.

24. A system according to claim 23, wherein the controller controls the pump to reduce a pressurization effect at the port when the seal is pressed against the borehole wall.

25. A system according to claim 18, wherein the flexible member flexes from the first position to the second position to provide a substantially zero volume in the first chamber.

26. A system according to claim 18, wherein the flexing of the flexible member flexes from the second position to the first position expels the first fluid from the first chamber through the port.

27. A system according to claim 18, wherein the sealing member and the port are on an extendable probe having a probe body and a bore for accepting the first fluid from the formation through the port.

* * * * *

UNITED STATES PATENT AND TRADEMARK OFFICE

CERTIFICATE OF CORRECTION

PATENT NO. : 7,416,023 B2
APPLICATION NO. : 10/871460
DATED : August 26, 2008
INVENTOR(S) : Sven Krueger et al.

It is certified that error appears in the above-identified patent and that said Letters Patent is hereby corrected as shown below:

Column 10, line 66, delete “downhole;” and insert --downhole; and--;

Column 10, line 67, delete the word “and”;

Column 11, line 6, delete “the fluid” and insert --the first fluid--;

Column 11, line 30, delete “sensor” and insert --a sensor--;

Column 11, line 41, delete “formation;” and insert --formation; and--;

Column 11, line 45, delete “of the fluid” and insert --of the first fluid--;

Column 11, line 53, delete “of the fluid” and insert --of the first fluid--;

Column 11, line 57, delete “associate” and insert --associated--;

Column 12, line 12, delete “including;” and insert --including:--;

Column 12, line 24, delete the word “and”;

Column 12, line 46, delete “seal” and insert --sealing member--;

Column 12, line 50, delete “the flexing of”; and

Column 12, line 52, delete “position expels” and insert --position to expel--.

Signed and Sealed this

Fourth Day of November, 2008

JON W. DUDAS
*Director of the United States Patent and Trademark Office*